US007802706B1

(12) United States Patent
Selsor

(10) Patent No.: US 7,802,706 B1
(45) Date of Patent: Sep. 28, 2010

(54) BELT HOLDER FOR A TOOL

(76) Inventor: Richard Selsor, 1309 S. Walnut Ave., Broken Arrow, OK (US) 74012

( * ) Notice: Subject to any disclaimer, the term of this patent is extended or adjusted under 35 U.S.C. 154(b) by 593 days.

(21) Appl. No.: 11/728,274

(22) Filed: Mar. 26, 2007

Related U.S. Application Data

(60) Provisional application No. 60/788,600, filed on Apr. 3, 2006.

(51) Int. Cl.
*A45C 1/04* (2006.01)
*A45F 3/00* (2006.01)

(52) U.S. Cl. ..... 224/269; 224/666; 224/667; 224/668; 224/669; 224/673

(58) Field of Classification Search ..... 224/269, 224/666, 667, 668, 669, 673
See application file for complete search history.

(56) References Cited

U.S. PATENT DOCUMENTS 1,326,887 A * 12/1919 Wood ..... 24/3.1
3,104,434 A * 9/1963 Noordhoek ..... 24/3.1
4,106,679 A 8/1978 Hillinger
4,270,587 A * 6/1981 Ludy ..... 81/23
4,358,036 A * 11/1982 Maltais ..... 224/667
4,746,042 A * 5/1988 King ..... 224/148.2
4,955,518 A * 9/1990 Parsons et al. ..... 224/247
4,974,764 A 12/1990 Cantwell
D345,052 S 3/1994 Stokke et al.
6,443,342 B1 9/2002 Kahn
6,641,011 B1 * 11/2003 Kahn ..... 224/269
2002/0117521 A1 8/2002 Brandt

* cited by examiner

*Primary Examiner*—Nathan J Newhouse
*Assistant Examiner*—Lester L Vanterpool
(74) *Attorney, Agent, or Firm*—George L. Williamson

(57) ABSTRACT

Apparatus and method for a clip-like device for attaching the head of a hammer or like tool to the belt which is being worn about the waist of a user. Various embodiments are shown wherein the clip may be attached to the head of the hammer in various ways.

3 Claims, 11 Drawing Sheets

BELT HOLDER FOR A TOOL

RELATED APPLICATIONS

This application claims benefit of U.S. Provisional Patent Application Ser. No. 60/788,600 filed Apr. 3, 2006.

BACKGROUND OF THE INVENTION

1. Field of the Invention

The present invention relates generally to hammers and, more particularly, is concerned with an attachment means for attaching a hammer or other tool to a belt.

2. Description of the Prior Art

Tool clips/holders have been described in the prior art. However, none of the prior art devices disclose the unique features of the present invention.

In U.S. Pat. No. Des. 345,052 dated Mar. 15, 1994, Stokke, et al., disclosed an ornamental design for a tool clip, as shown and described.

In U.S. Patent Pub. No. US 2002/0117521 A1, dated Aug. 29, 2002, Brandt disclosed a tool-toting device for connection to a belt to be worn about the waist of a tradesman for the purpose of carrying a tool of a type having an elongated handle and angled or transverse head portion which includes a support backing associable as part of the belt and a tool support spring clip having a first generally horizontally disposed side-spring clip portion having a first and second end and connected to the support backing.

In U.S. Pat. No. 4,974,764, dated Dec. 4, 1990, Cantwell disclosed a belt clip for supporting a tool which comprises a generally U-shaped member including a curved central portion, a first and a second leg connected to the central portion and an end portion of the first leg being movably connected to the curved central portion and being directed towards the second leg.

In U.S. Pat. No. 6,443,342 B1 dated Sep. 3, 2002, Kahn disclosed a tool belt tool tote device that is capable of carrying two tools independently, such as a cordless drill and a hammer. The double tool tote device comprises a C-shaped clip, a terminal swivel element and two hook elements.

In U.S. Pat. No. 4,106,679 dated Aug. 15, 1978, Hillinger disclosed a tool holder particularly suited for carrying a hammer or a hatchet from a wearer's waist belt which includes a tool suspension arrangement joined to a waist belt suspended pliant pad. The tool suspension arrangement comprises a pivot rod extending normally from and joined to the pad and a protruding support element.

While these tool clips/holders may be suitable for the purposes for which they were designed, they would not be as suitable for the purposes of the present invention, as hereinafter described.

SUMMARY OF THE PRESENT INVENTION

The present invention discloses a clip-like device for attaching the head of a hammer or like tool to the belt which is being worn about the waist of a user. Various embodiments are shown wherein the clip may be attached to the head of the hammer in various ways.

An object of the present invention is to allow a hammer to be worn about the waist belt of a user without the necessity of any particular type of hammer loop being on the belt. A further object of the present invention is to provide a universal clip so that any hammer can be attached to any belt being worn about the waist of a user.

Additional objects of the present invention will appear as the description proceeds.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
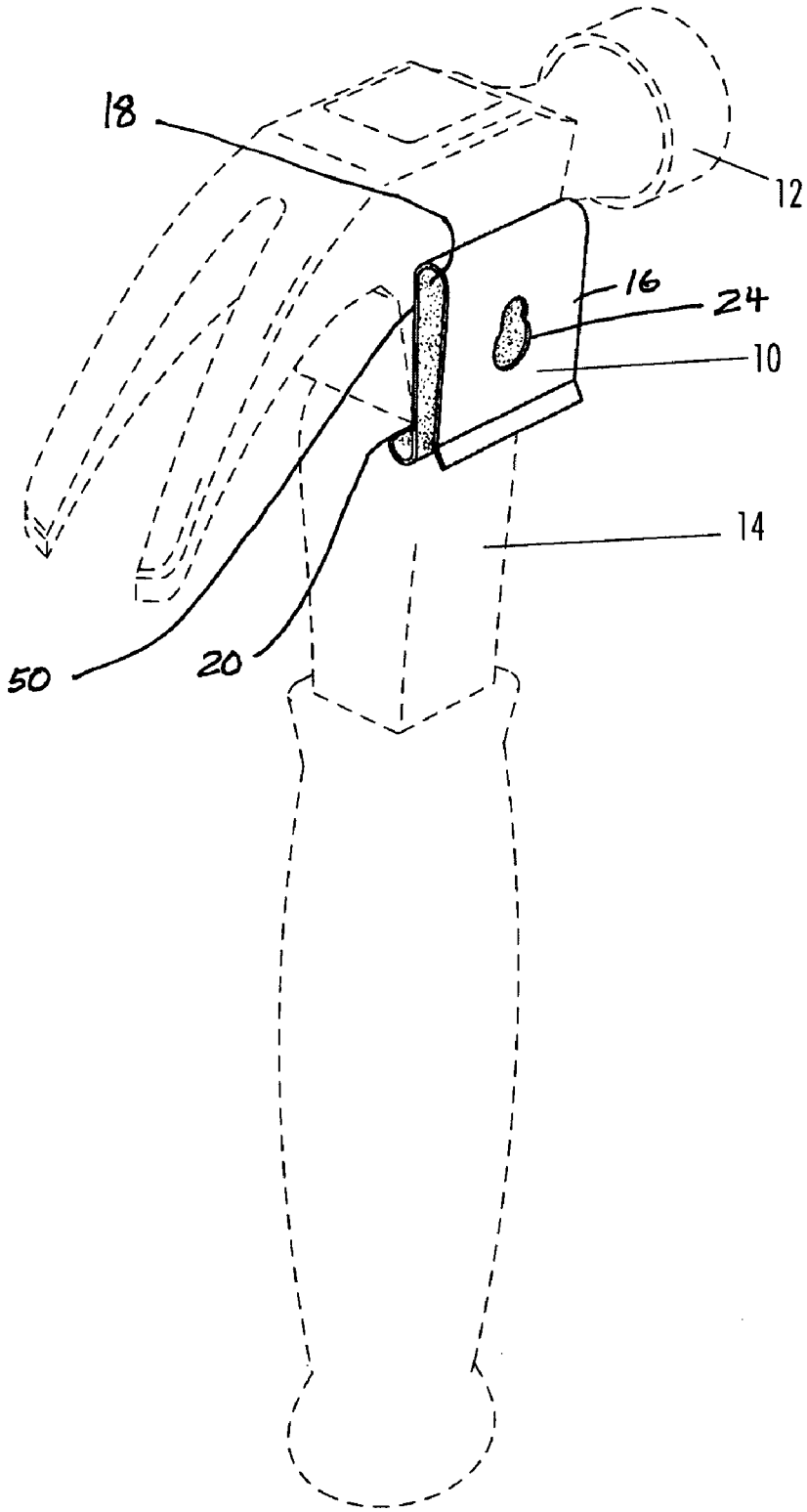
FIG. 1 is a perspective view of one embodiment of the present invention.

With regard to reference numerals used, the following numbering is used throughout the drawings.

10 present invention
12 head
14 hammer
16 outer member/portion
18 belt loop/slot
20 inner member/portion
22 handle

24 key hole
26 collar
28 foam
30 screw
32 spot weld
34 adhesive
36 male member
38 female member
40 belt
42 fiber mesh
44 shrink wrap
45 rubber material
46 user
47 arrow
50 center member/portion

DETAILED DESCRIPTION OF THE PREFERRED EMBODIMENTS

The following discussion describes in detail the present invention. This discussion should not be construed, however, as limiting the invention to those particular embodiments since practitioners skilled in the art will recognize numerous other embodiments as well. For a definition of the complete scope of the invention, the reader is directed to the appended claims. FIGS. 1 through 16 illustrate the present invention wherein a tool clip is disclosed for attaching a hammer or like tool to the waist belt of a user.

Figure 2:
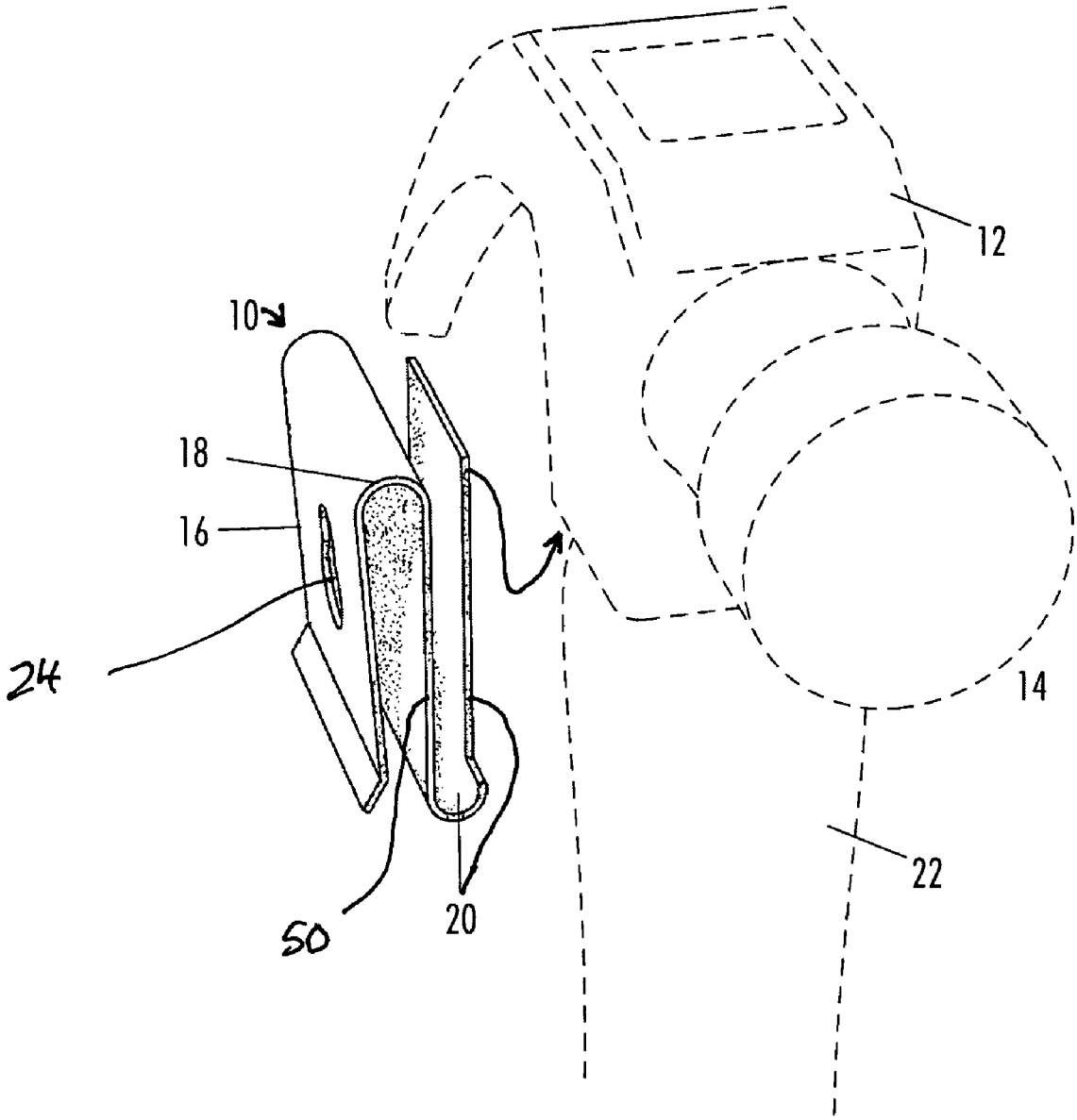
FIG. 2 is an exploded view of one embodiment of the present invention.

FIGS. 1 and 2 discloses one embodiment of the present invention 10. FIG. 1 discloses the present invention 10 attached to the side of the head 12 of a hammer 14. The present invention 10 is a clip which can be used to attach a hammer 14 to a belt being worn about the waist of a user having an outer first member 16 which forms a slot or belt loop 18 for receiving the top edge of a belt therein having an inner member 20 which can be inserted between the hammer head 12 and the handle 22 of the hammer 14 much as a shim would be done as indicated by the arrow.

FIG. 2 discloses the present invention 10 having an outer first member 16 which forms a slot or belt loop 18 for receiving the top edge of a belt therein having an inner member 20 which can be inserted between the hammer head 12 and the handle 22 of the hammer 14 much as a shim would be done as indicated by the arrow. This would firmly connect the present invention 10 to the hammer 14. Also shown is center member 50. Note that the upper end of the present invention 10 is toward the head 12 of the hammer 14 while the lower end is toward the handle 22. Note that the hammer 14 may constructed in the conventional manner wherein the handle 22 is inserted into a hole or receptacle in the head 12. Each member/portion 16, 20, 50 has an upper and lower end, wherein the lower end of the inner member is connected to the lower end of the central member by an upwardly disposed U-shaped bend, wherein the upper end of the outer member is connected to the upper end of the central member by a downwardly disposed U-shaped bend, wherein the downwardly disposed U-shaped bend forms a slot 18 for receiving the belt of the user therein, and, wherein the inner member is inserted between the handle 22 and the head 12 of the hammer 14 so that the clip 10 is connected to the hammer.

Figure 3:
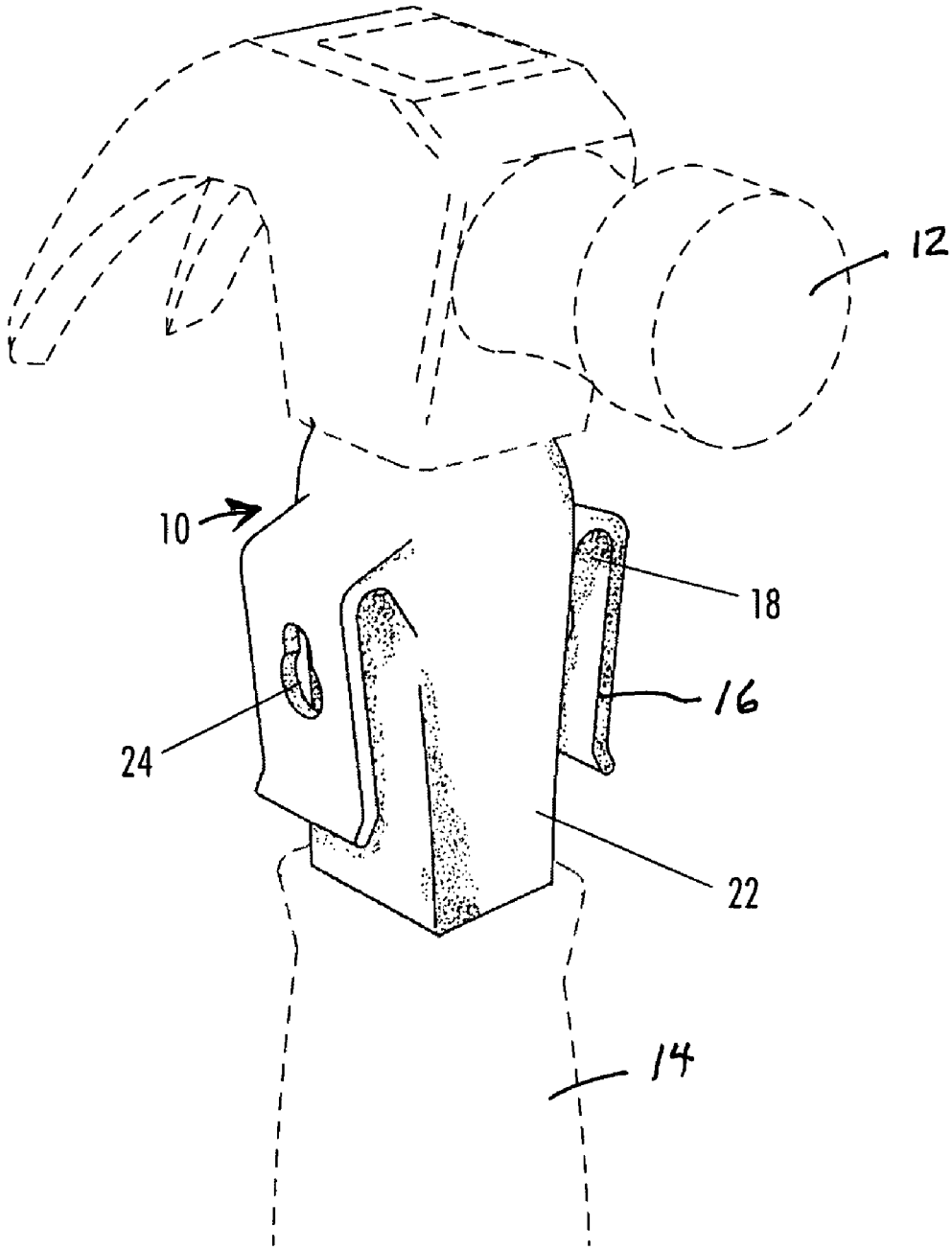
FIG. 3 is a perspective view one embodiment of the present invention.

Turning to FIG. 3, therein is shown the present invention 10 integrally formed with or molded into the side of the handle 22 of the hammer 14 so as to provide a slot, clip or belt loop 18 on each side of the present invention, also having a key hole 24 which would allow the hammer to be hung on a nail head or the like. Outer member 16 is also shown. Slot 18 is formed by a downwardly U-shaped bend.

Figure 4:
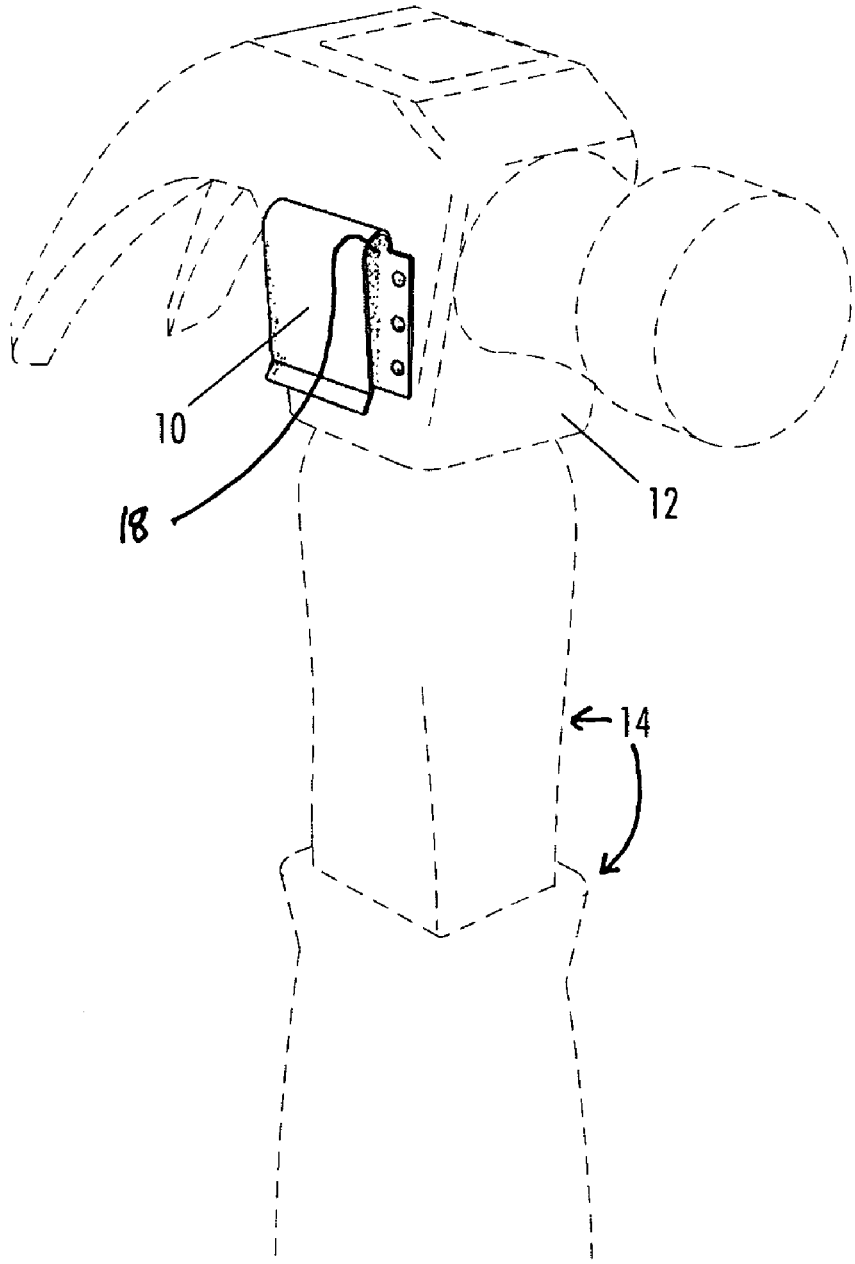
FIG. 4 is a perspective view one embodiment of the present invention.

Turning to FIG. 4, therein is shown the present invention 10 being disposed on the side of the head 12 of the hammer 14 which can be done during either production or as an after-market process.

Figure 5:
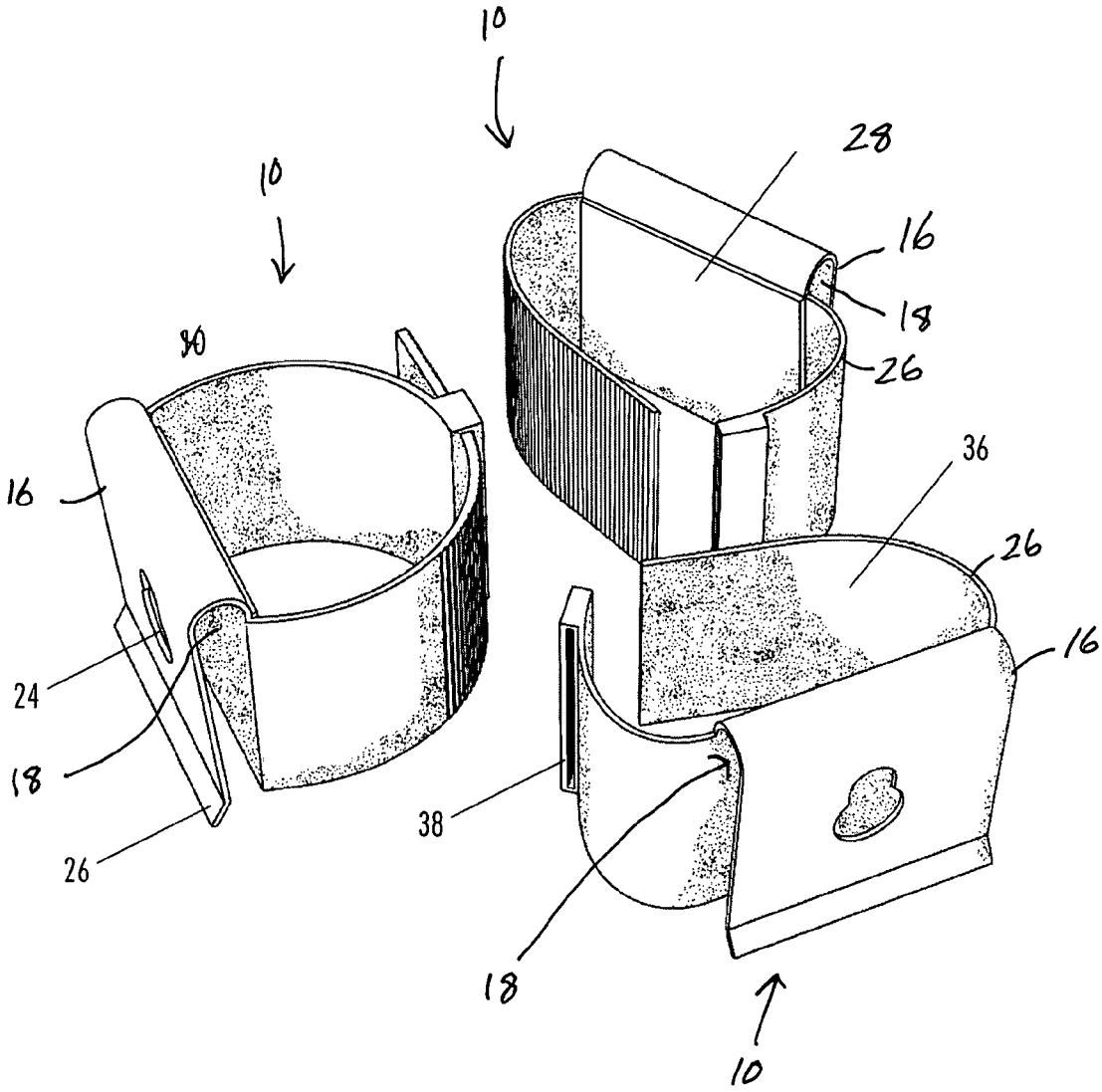
FIG. 5 is a perspective view one embodiment of the present invention.

Turning to FIG. 5, therein is shown the present invention 10 in the form of a plastic collar 26 similar to a zip tie having male 36 and female 38 members that would fit around the handle of the hammer so as to provide a means for attaching the hammer to the belt of a user. Different sizes and thicknesses of the present invention 10 could be molded to fit the hammer or any other tool. Also shown is adhesive foam padding 28 for tightly securing the present invention 10 to the hammer. Key hole 24, outer member 16 and slot 18 are also shown.

Figure 7:
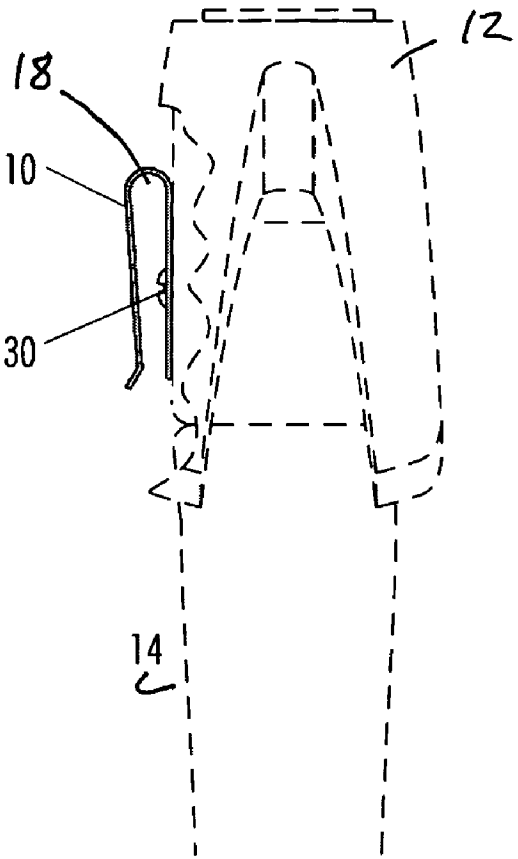
FIG. 7 is a side view of one embodiment of the present invention.
Figure 6:
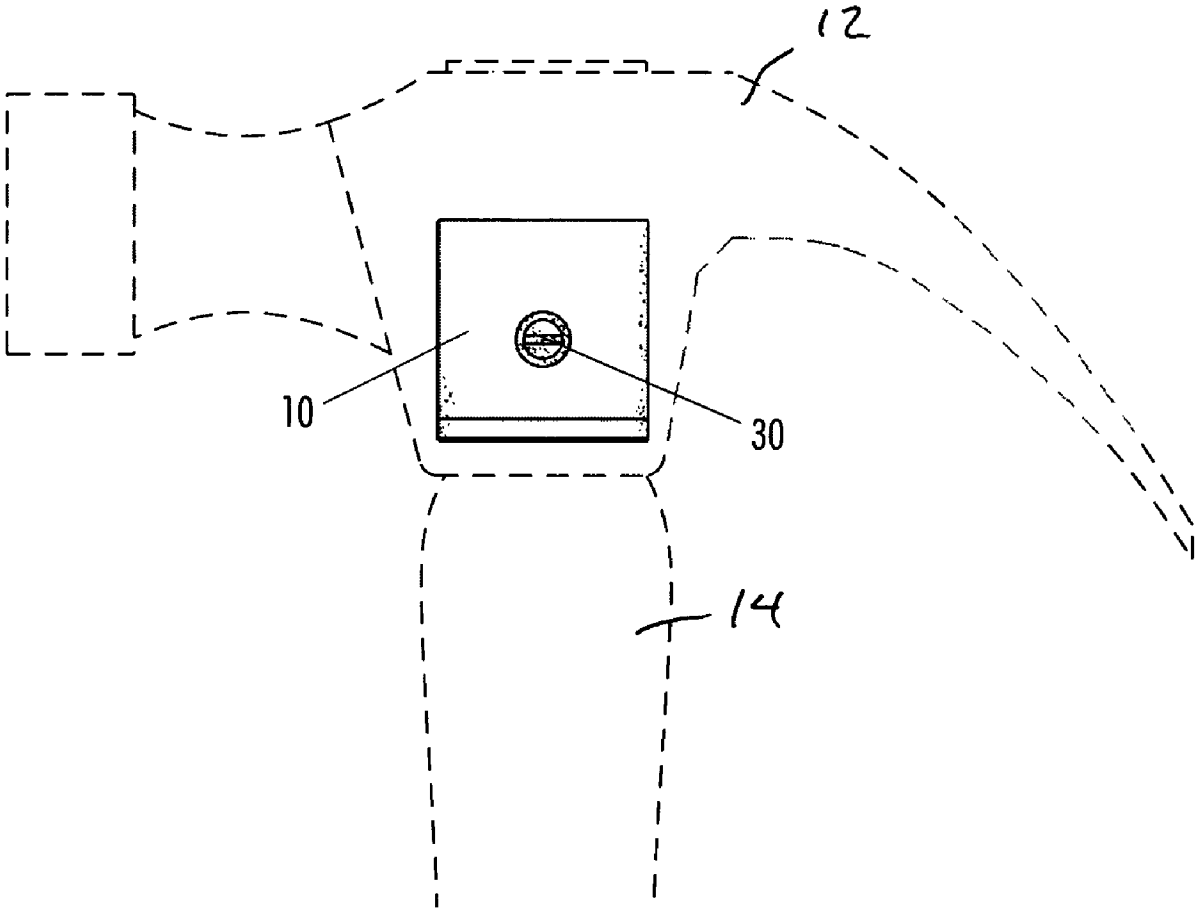
FIG. 6 is an elevation view of one embodiment of the present invention.

Turning to FIGS. 6 and 7, therein is shown the present invention 10 being disposed on the side of the head of a hammer using a screw 30.

Figure 9:
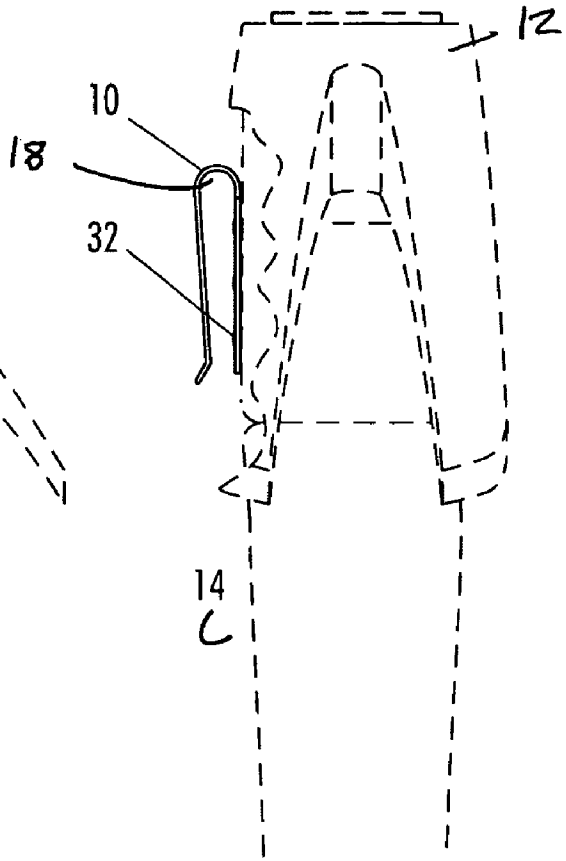
FIG. 9 is a side view of one embodiment of the present invention.
Figure 8:
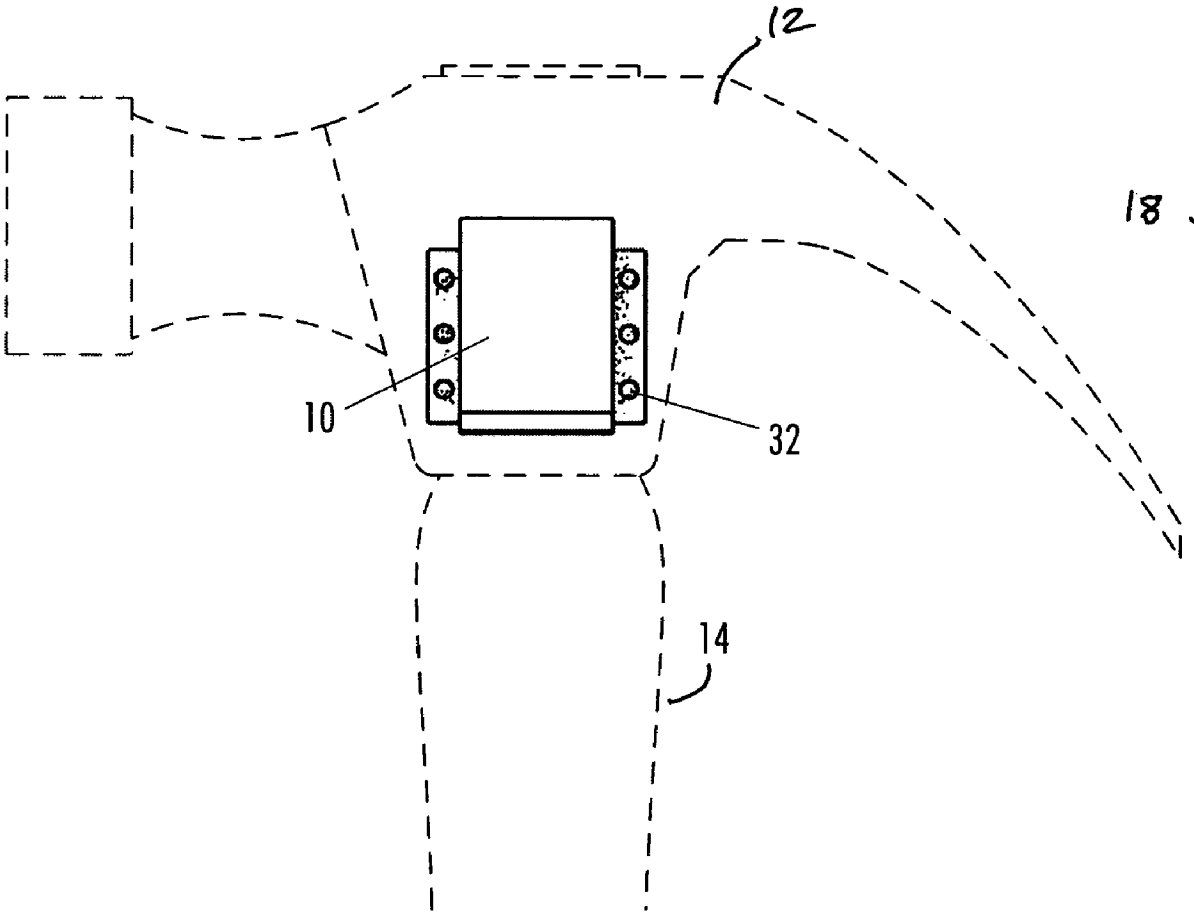
FIG. 8 is an elevation view of one embodiment of the present invention.

Turning to FIGS. 8 and 9, therein is shown the present invention 10 being attached to the head of the hammer 14 using spot welds 32.

Figure 11:
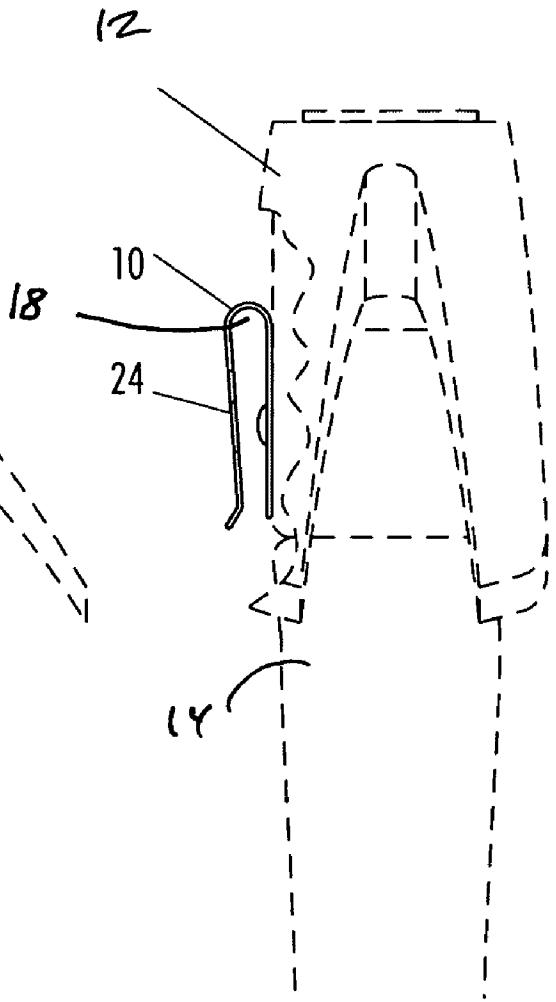
FIG. 11 is a side view of one embodiment of the present invention.
Figure 10:
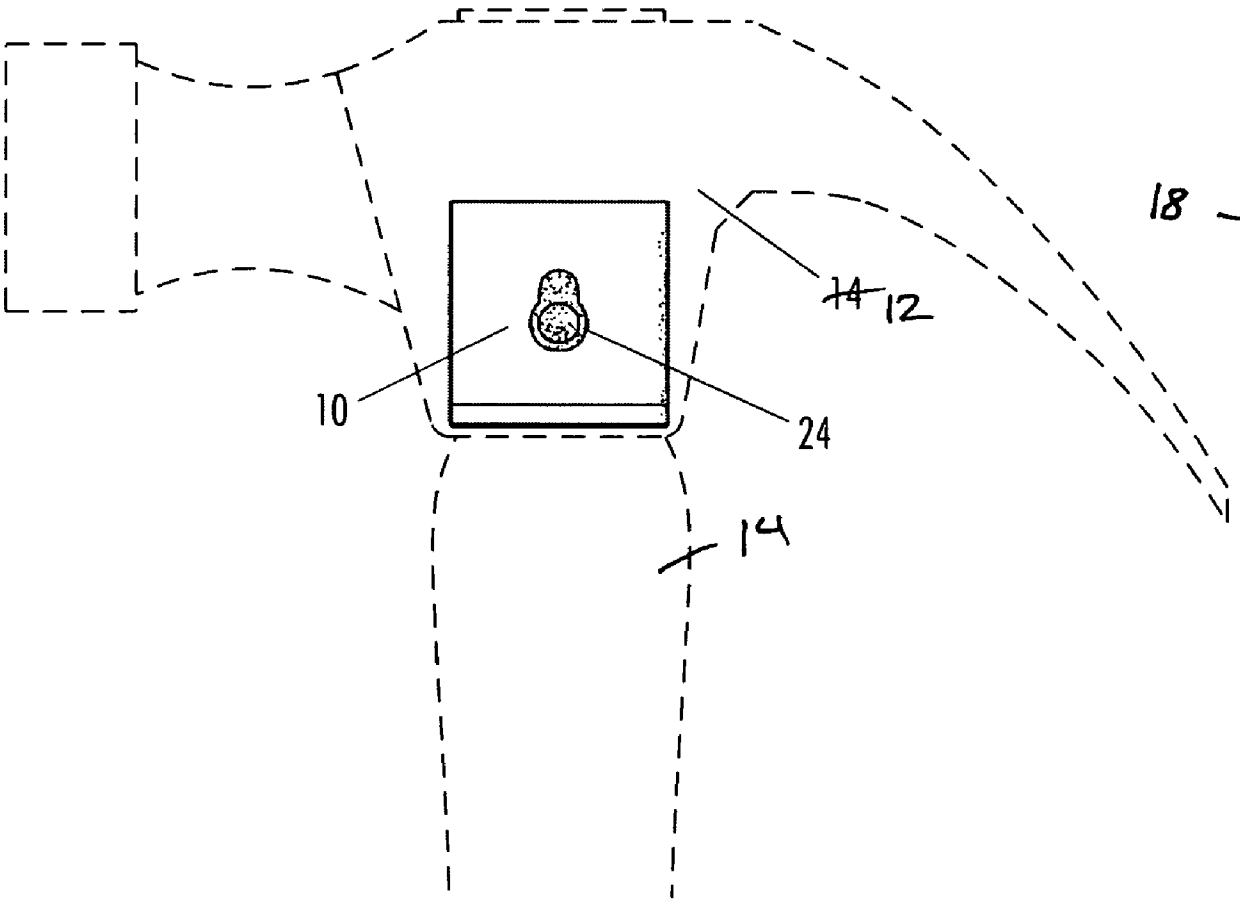
FIG. 10 is an elevation view of one embodiment of the present invention.

Turning to FIGS. 10 and 11, therein is shown the present invention 10 being attached to the side of the head of the hammer 14 having a key hole 24 for being hung on a nail or the like.

Figure 13:
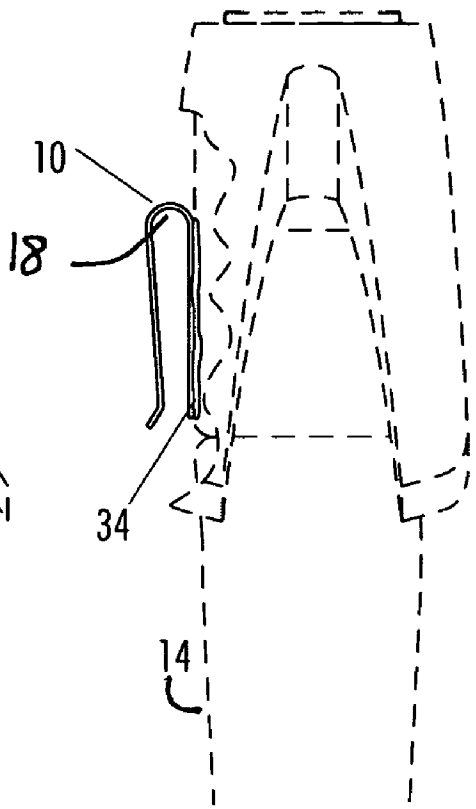
FIG. 13 is a side view of one embodiment of the present invention.
Figure 12:
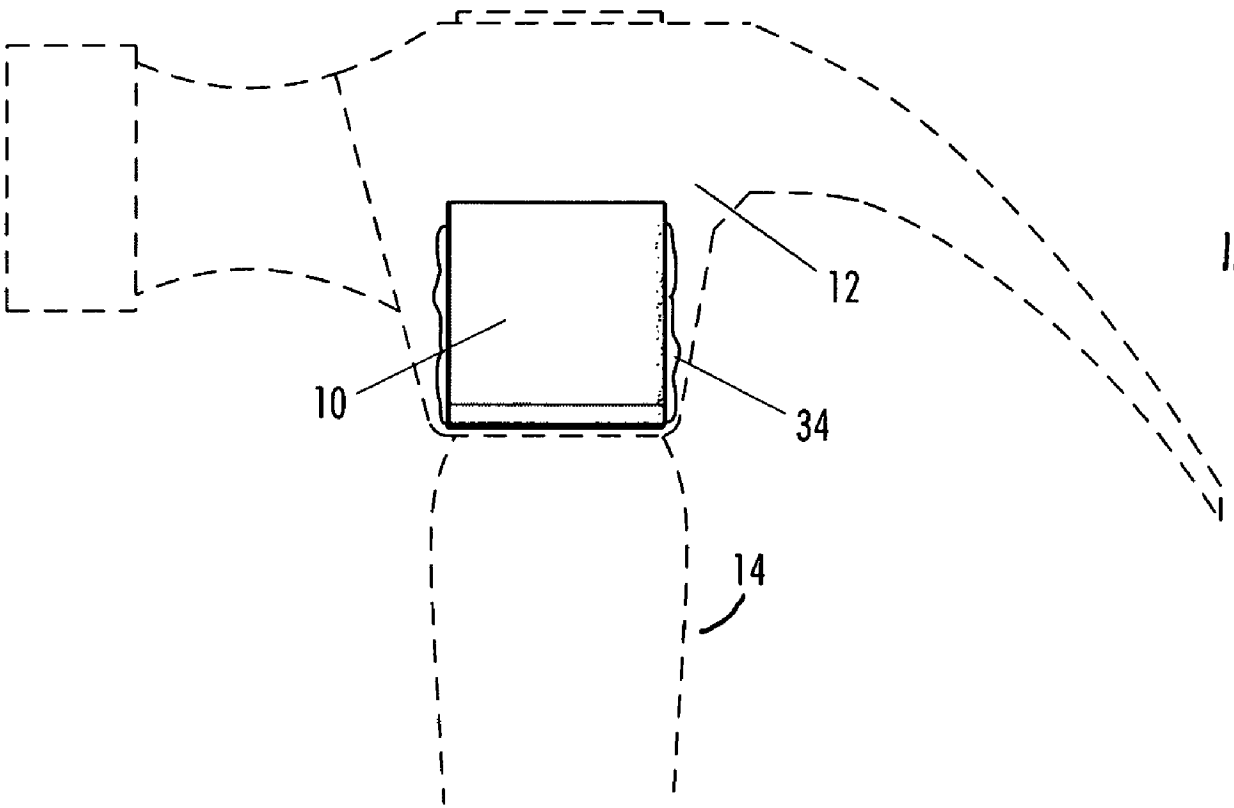
FIG. 12 is an elevation view of one embodiment of the present invention.

Turning to FIGS. 12 and 13, therein is shown the present invention 10 being attached to the head 12 of the hammer 14 using adhesive, e.g., epoxy 34 or the like.

Figure 15:
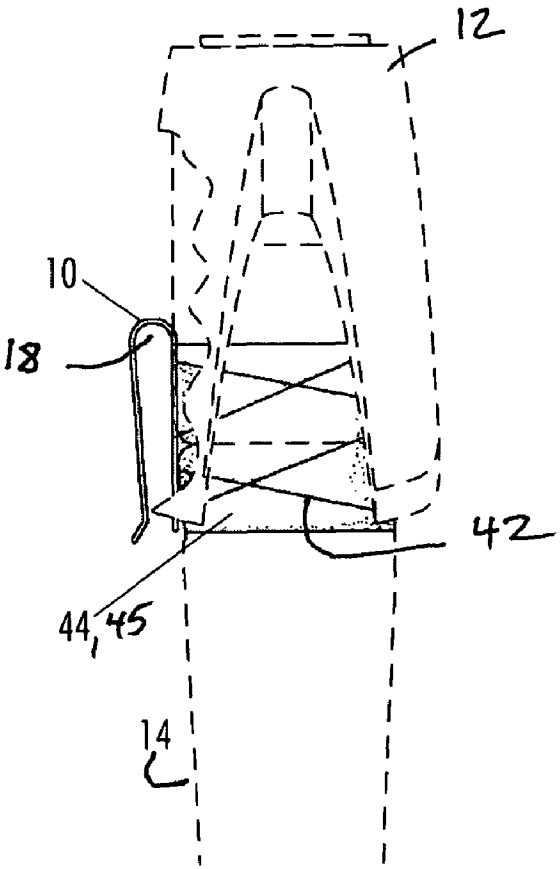
FIG. 15 is a side view of one embodiment of the present invention.
Figure 14:
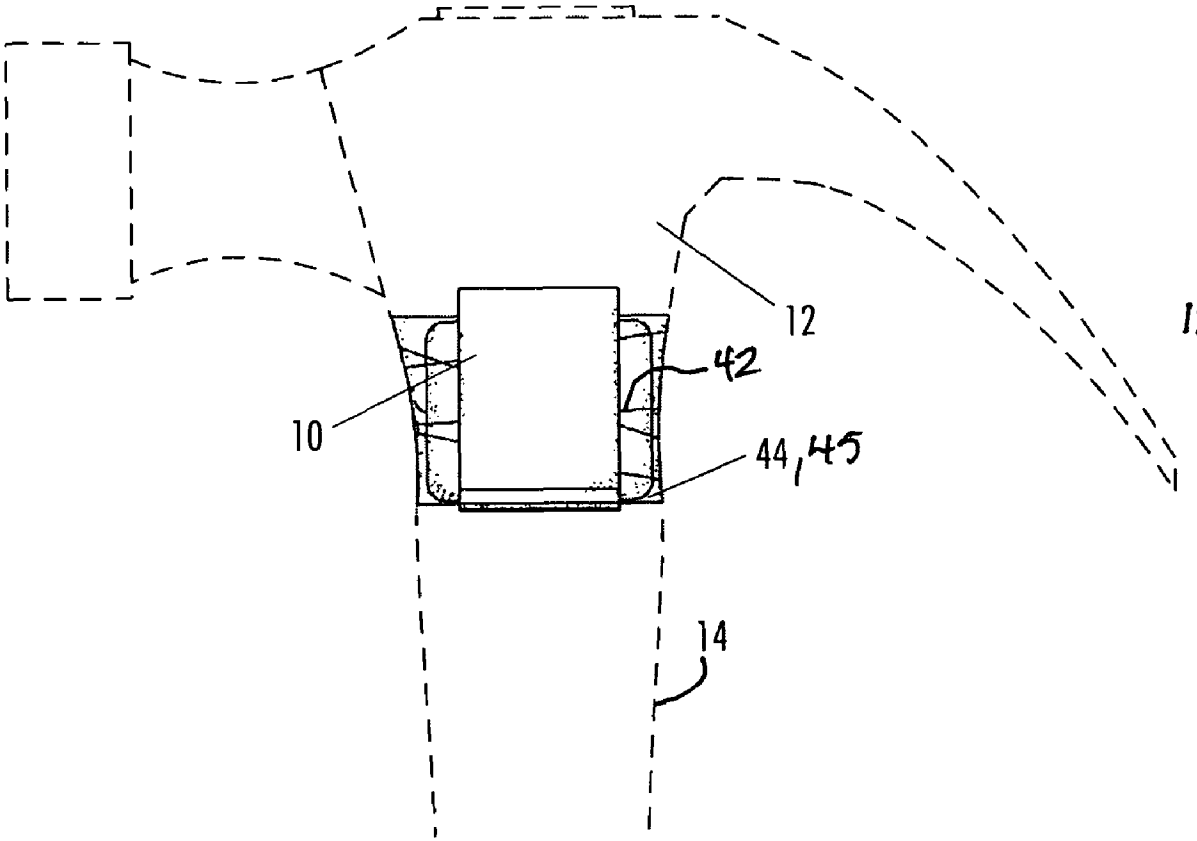
FIG. 14 is an elevation view of the one embodiment of the present invention.

Turning to FIGS. 14 and 15, therein is shown two embodiments of the present invention 10 being attached to the head 12 of the hammer 14 using shrink wrap 44 or a rubber covering material 45. If a rubber cover 45 were used then also shown associated with the rubber material would be fiber mesh 42. No fiber mesh 42 would be associated with the shrink wrap alternative 44.

Figure 16:
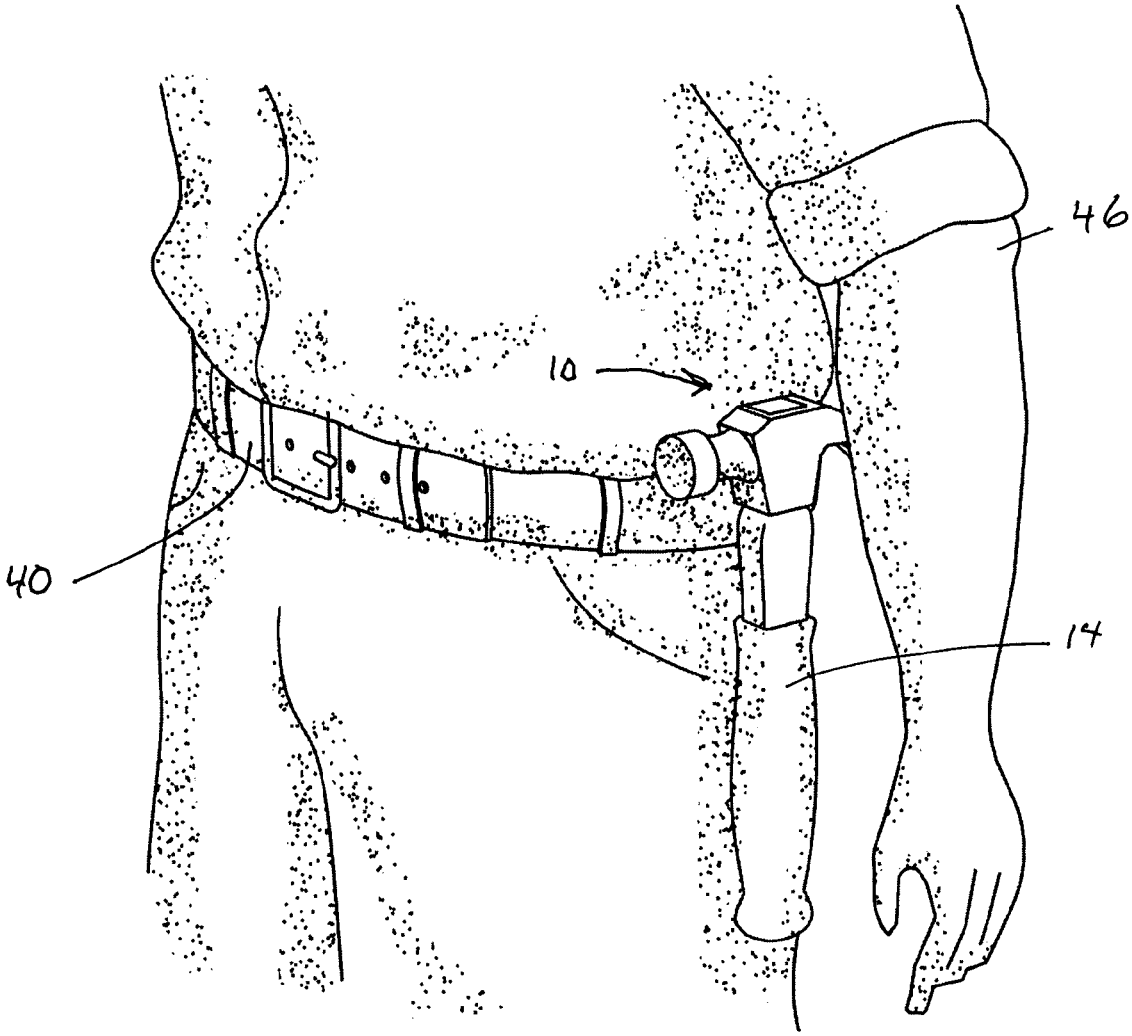
FIG. 16 is an illustration of the present invention being worn on the waist belt of a user.

Turning to FIG. 16, therein is shown the present invention 10 for attaching a hammer 14 to the waist belt 40 of a user 46.

In each of the embodiments, slot 18 is formed by a downwardly U-shaped bend.

I claim:

1. An apparatus for attaching a hammer or like to a belt being worn by a user, the hammer having a head and a handle thereon, in combination, comprising:

a) a clip having a slot therein, said slot for receiving the belt of the user therein;

b) wherein said clip further comprises of an inner member, a central member and an outer member, wherein each said member has an upper and lower end, wherein said lower end of said inner member is connected to said lower end of said central member by an upwardly disposed U-shaped bend, wherein said upper end of said outer member is connected to said upper end of said central member by a downwardly disposed U-shaped bend, wherein said downwardly disposed U-shaped bend forms said slot for receiving the belt of the user therein;

c) wherein said inner, central and outer members are made of a single piece of material;

d) wherein said inner, central and outer members are the same width; and, e) wherein said inner member is inserted between the handle and the head of the hammer in a shim-like manner so that said clip is connected to the hammer, wherein said clip is carried on the hammer after attachment.

2. The apparatus of claim 1, wherein said outer member has a key hole therein for hanging the hammer.

3. A method for attaching a hammer or like to a belt being worn by a user, the hammer having a head and a handle thereon, comprising the steps of:

a) providing a clip having a slot therein, the slot for receiving the belt of the user therein;

b) providing an inner member, a central member and an outer member on the clip, wherein each member has an upper and lower end, connecting the lower end of the inner member to the lower end of the central member by an upwardly disposed U-shaped bend, connecting the upper end of the outer member to the upper end of the central member by a downwardly disposed U-shaped bend, wherein the downwardly disposed U-shaped bend forms said slot for receiving the belt of the user therein;

c) forming the inner, central and outer members of a single piece of material;

d) forming the inner, central and outer members to be the same width; and, e) inserting the inner member between the handle and the head of the hammer in a shim-like manner so that the clip is connected to the hammer, wherein the clip is carried on the hammer after attachment.

* * * * *